US009903105B2

(12) United States Patent
Tomberlin et al.

(10) Patent No.: US 9,903,105 B2
(45) Date of Patent: Feb. 27, 2018

(54) FLOW SHIELD

(71) Applicants: Nathan L Tomberlin, Decatur, AL (US); Courtney W Tomberlin, Decatur, AL (US)

(72) Inventors: Nathan L Tomberlin, Decatur, AL (US); Courtney W Tomberlin, Decatur, AL (US)

( * ) Notice: Subject to any disclaimer, the term of this patent is extended or adjusted under 35 U.S.C. 154(b) by 74 days.

(21) Appl. No.: 15/160,721

(22) Filed: May 20, 2016

(65) Prior Publication Data

US 2016/0340889 A1 Nov. 24, 2016

Related U.S. Application Data

(60) Provisional application No. 62/165,474, filed on May 22, 2015.

(51) Int. Cl.
*E03F 5/06* (2006.01)
*E03F 5/04* (2006.01)
*E03F 5/046* (2006.01)

(52) U.S. Cl.
CPC ..... *E03F 5/0404* (2013.01); *E03F 5/046* (2013.01); *E03F 5/0411* (2013.01); *E03F 5/06* (2013.01)

(58) Field of Classification Search
CPC ..... E03F 5/0401; E03F 5/0404; E03F 5/0411; E03F 5/046; E03F 5/06; E03F 5/14
USPC ..... 210/162, 163, 170.03; 404/4, 5
See application file for complete search history.

(56) References Cited

U.S. PATENT DOCUMENTS 1,654,246 A * 12/1927 Egan ..... E03F 5/046 210/163
5,403,474 A * 4/1995 Emery ..... E03F 5/046 210/163
5,954,952 A * 9/1999 Strawser, Sr. ..... E03F 5/0404 210/164
6,017,166 A * 1/2000 Mossburg, Jr. ..... E03F 5/0404 210/163
6,641,335 B1 11/2003 Allard
6,709,579 B1 * 3/2004 Singleton ..... E03F 5/0404 210/163
7,074,326 B2 7/2006 Singleton
7,131,787 B2 11/2006 McGinn
7,300,574 B1 * 11/2007 Lewis ..... E03F 5/0404 210/163
7,357,861 B2 * 4/2008 Kelley ..... E03F 5/0404 210/162
7,544,016 B2 6/2009 McGinn et al.
7,744,308 B2 1/2010 Bussey, Jr. et al.
7,901,160 B2 3/2011 D'Andreta et al.
7,922,916 B1 * 4/2011 Witt ..... E03F 5/0404 210/162
8,051,568 B2 11/2011 Moody et al.
8,088,279 B2 1/2012 McInnis et al.
8,388,835 B2 * 3/2013 Haschke ..... E03F 5/0404 210/162
8,980,084 B2 3/2015 Dorsey
(Continued)

*Primary Examiner* — Christopher Upton
(74) *Attorney, Agent, or Firm* — Cynthia R. Wright

(57) ABSTRACT

The present invention relates to a curb, grate, and combination curb and grate inlet temporary filtering system to filter silt, sedimentation and debris from runoff entering a storm water drainage system. The invention comprises a body sized to fit over the inlet and includes one or more support members encapsulated with a filter material that assists in the filtering of water entering the storm sewer inlet.

11 Claims, 7 Drawing Sheets

(56) References Cited

U.S. PATENT DOCUMENTS

| | | | | |
|---|---|---|---|---|
| 2007/0205144 | A1* | 9/2007 | Robinson | E04D 13/0767 210/163 |
| 2012/0292239 | A1* | 11/2012 | Lill | E03F 5/06 210/163 |
| 2014/0027362 | A1* | 1/2014 | Kent | E03F 5/0404 210/170.03 |

* cited by examiner

FLOW SHIELD

CROSS-REFERENCE TO RELATED APPLICATIONS

This application claims priority to U.S. Provisional Application Ser. No. 62/165,474, filed May 22, 2015, which is incorporated by reference herein in its entirety.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM

Not applicable.

STATEMENT REGARDING PRIOR DISCLOSURES BY THE INVENTOR OR JOINT INVENTOR

The inventors did not disclosed the invention herein prior to the 12 month period preceding the filing of this nonprovisional application.

BACKGROUND OF THE INVENTION (1) Field of the Invention

The present invention, the Flow Shield generally relates to an apparatus and method that reduces the amount of silt, sediment, and debris entering a storm sewer during water runoff from a construction site. The apparatus is a rigid structure covered with an exterior filter that fits over the opening of a standard combination curb and gutter system. The device is placed over the standard combination curb and gutter system during site construction to remove silt and sedimentation from water entering the sewer system. The Flow Shield can be quickly installed over a any standard curb or gutter inlet system. Removal of the Flow Shield can be performed quickly and easily upon the complete of construction site activities. The Flow Shield is stackable, allowing a number of devices to be stacked together to facilitate transport of the devices from job site to job site. Stackability also reduces the space required for storage of the Flow Shield. The Flow Shield does not retain moisture allowing it to be stored immediately after use. The filter attachment and design facilitates efficient silt and sedimentation filtering and removal of debris.

(2) Description of Related Art

Storm water runoff is produced when precipitation from rain and snow melt flows over land and impervious surfaces and does not percolate into the land. As the storm water runoff flows over land and impervious surfaces it accumulates silt, sediment, pollutants and other debris. The silt, sediment, pollutants and other debris can contaminate the water if the water is left untreated. Once the storm water runoff enters a storm sewer system, the silt, sedimentation, and debris can accumulate within the system obstructing the flow of runoff. Federal, state, and local authorities regulate runoff pollution and limit the amount of silt, sedimentation, and debris within storm water runoff. These regulations require commercial and residential construction to minimize particulate in runoff and to prevent the flow of particulate matter into a sewer system.

The types of storm sewer drain inlets in common use include curb inlets, gutter inlets, and combination curb and gutter inlets. A curb inlet is just a vertical opening in the curb. A gutter inlet includes an opening in a horizontal section of the road. Gutter inlets may also include a vertical section of drain stemming from the horizontal opening. Gutter inlets typically have a grate covering the opening, while curb inlets are typically open without a grate. Combination curb and gutter systems have a vertical curb opening and a horizontal grated opening in the bottom of the gutter.

During construction of both residential and commercial buildings, grading and land excavation are typically ongoing throughout the duration of construction activities. Construction equipment such as bull dozers, back hoes, and excavators are constantly tracking mud and debris onto newly built roads and existing streets. Rainfall can wash the mud and debris into nearby storm sewers that are designed to carry the water to nearby tributaries and to water treatment facilities. Although seeding and mulching is common practice during construction, erosion of exposed earth especially during heavy storms can be substantial. Heavy rainfall can strip a construction site of loose silt and sediment. The silt and sediment may drain into a nearby storm sewer system. And, over time, the silt and sediment can accumulate within the sewer system.

Environment regulations prevent the accumulation of silt and sediment in a sewer system. A builder found to be in violation of storm water runoff regulations can be sanctioned by federal, state, and local officials. If silt and sediment do accumulate in a sewer system, the process of removing the particulate can be time consuming and costly to the builder or developer. Often it is necessary to rent expensive equipment and to hire specialized personnel to physically enter the structure or pipe and remove the sedimentation. This can add cost to the construction project and be dangerous to the personnel removing the silt and sediment. Additionally, OSHA mandates relating to subjecting a worker to a confined work space may be violated subjecting the builder to additional sanctions.

A number of devices have been disclosed and implemented to reduce silt and sediment discharge into a storm sewer system. The simplest storm water filtration device is created by placing one or more bales of straw in front of or on top of a storm drain. "Wattles" are another simple device commonly seen on active construction sites to filter debris out of runoff before it enters a storm drain. A "wattle" is a tubular mesh bag made of jute, hemp, or another woven material that is typically filled with wood chips such as hog fuel, or with some other absorbent material such as straw. Wattles are also placed on top of or in front of a sewer grate. Bussey, Jr. et al (U.S. Pat. No. 7,744,308 B2) discloses a oval-shaped tubular mesh bag containing filter material that is placed in front of a drainage element to filter debris from the runoff. Each of these three devices is difficult or impossible to stake down and all of them are subject to floating away during a heavy downpour. These devices usually do a poor job of trapping silt and sediment.

McGinn (U.S. Pat. No. 7,131,787 B2) discloses a drain inlet cover to filter runoff entering a gutter inlet. The device includes a horizontal section lying on the road and a vertical section covering the opening in the curb. Each section includes a filter member lying between two apertured polymeric members. This device requires that a berm be placed around the horizontal section of the device so that some sediment can settle out of the sediment-bearing liquid before it reaches the device. The requirement that a berm be fashioned to remove sediment from storm water severely limits the utility of the device. Additionally, this device limits the size of the vertical filter member which permits the free flow of runoff into the space above the filter member and below the curb. This allows runoff to flow without any silt, sediment or debris removal, which may violate environmental laws and regulations subjecting the builder to penalty.

Moody (U.S. Pat. No. 8,051,568 B2) discloses a temporary grate cover installed during construction activities. The device is composed of an expanded metal such as stainless steel with an attached geotextile fabric. The fabric is a filter weave high flow monofilament fabric, such as a woven polyethylene fabric. The device is attached to the grate with toggle bolts. This grate cover includes a flattened expanded metal with diamond shaped openings, which may be sized at about ¾×1¾". Because curb inlets lack a grate in which to attach this device, this device can only be used on gutter inlet systems. The Moody device includes an embodiment for use with systems including a curb opening. This embodiment has one side turned up to form a vertical filter portion. But this embodiment offers no mechanism to attach the turned up portion of the device to the curb inlet, which weakens the device making less effective in heavy downpours or when heavy or a large quantity of debris is present in the runoff.

D'Andreta et al. (U.S. Pat. No. 7,901,160 B2) discloses a gutter grate cover molded onto a storm drain by driving over it or otherwise deflecting it from a generally upright orientation. The device is self-supporting and includes two substantially solid sheet portions containing apertures. A filter is positioned so that it filters runoff entering through the apertures. This device is molded to the curb by driving a bobcat or other wheeled vehicle over the device. But, concrete curbs are easily damaged by contact with construction equipment. The use of this device at a construction site may necessitate the use of remedial measures to remove and replace damaged curbs.

BRIEF SUMMARY OF THE INVENTION

The Flow Shield generally comprises a curb, grate, and combination curb and grate inlet temporary filtering system to filter silt, sedimentation and debris from runoff entering a storm water drainage system. The Flow Shield enables water to pass therethrough the storm sewer inlet, while preventing a substantial portion of silt and debris flowing with the water from passing into the inlet. The Flow Shield generally includes a body that supports a filter medium. The body is sized to fit over the inlet and is sized for curb inlets, gutter inlets, and combination curb and gutter inlets. The body includes one or more support members encapsulated with a filter material that assists in the filtering of water entering the storm sewer inlet.

The body includes a grid or support structure formed from one or more supports. The grid provides points of attachment for the filter. The grid is rigid enough to withstand the force of the runoff while permitting the easy flow of said runoff. The filter includes geosynthetic materials, wire screens, mesh materials, and various synthetics, nylons and/or natural woven or knitted fibers and combinations thereof, or other appropriate filtration material.

Various aspects of the Flow Shield will become apparent to those skilled in the art upon reading the following detailed description, when taken in conjunction with the accompanying drawings.

DETAILED DESCRIPTION OF THE INVENTION

The invention is described in detail in the following paragraphs with reference to the attached drawings. Throughout this detailed description of the invention, the disclosed embodiments and features are to be considered as examples, rather than being limitations to the invention. Modifications to particular examples within the spirit and scope of the present invention, set forth in the appended claims, will be readily apparent to one of ordinary skill in the art. Further, reference to various embodiments of the disclosed invention does not mean that all claimed embodiments or methods must include every described feature. The various disclosed embodiments and features of the invention may be used separately or together, and in any combination. Terminology used herein is given its ordinary meaning consistent with the exemplary definitions set forth below.

The Flow Shield is a structure designed to be sit atop a storm sewer inlet. It fully covers the inlet and is anchored into the optimum position. The Flow Shield is composed of a rigid grid body covered with an attached filter. The body is composed of any material rigid enough to withstand the force of water runoff while permitting the easy flow of water through said body. The body may be composed of any high density material such as polyethylene, polyvinyl chloride, stainless steel, iron, or other suitable material. Each end of the Flow Shield follows the profile of a standard combination curb and gutter inlet which allows the ends of the Flow Shield to lay flush in the gutter or edge of the road. The Flow Shield encloses the entire curb or gutter grate inlet.

Figure 1:
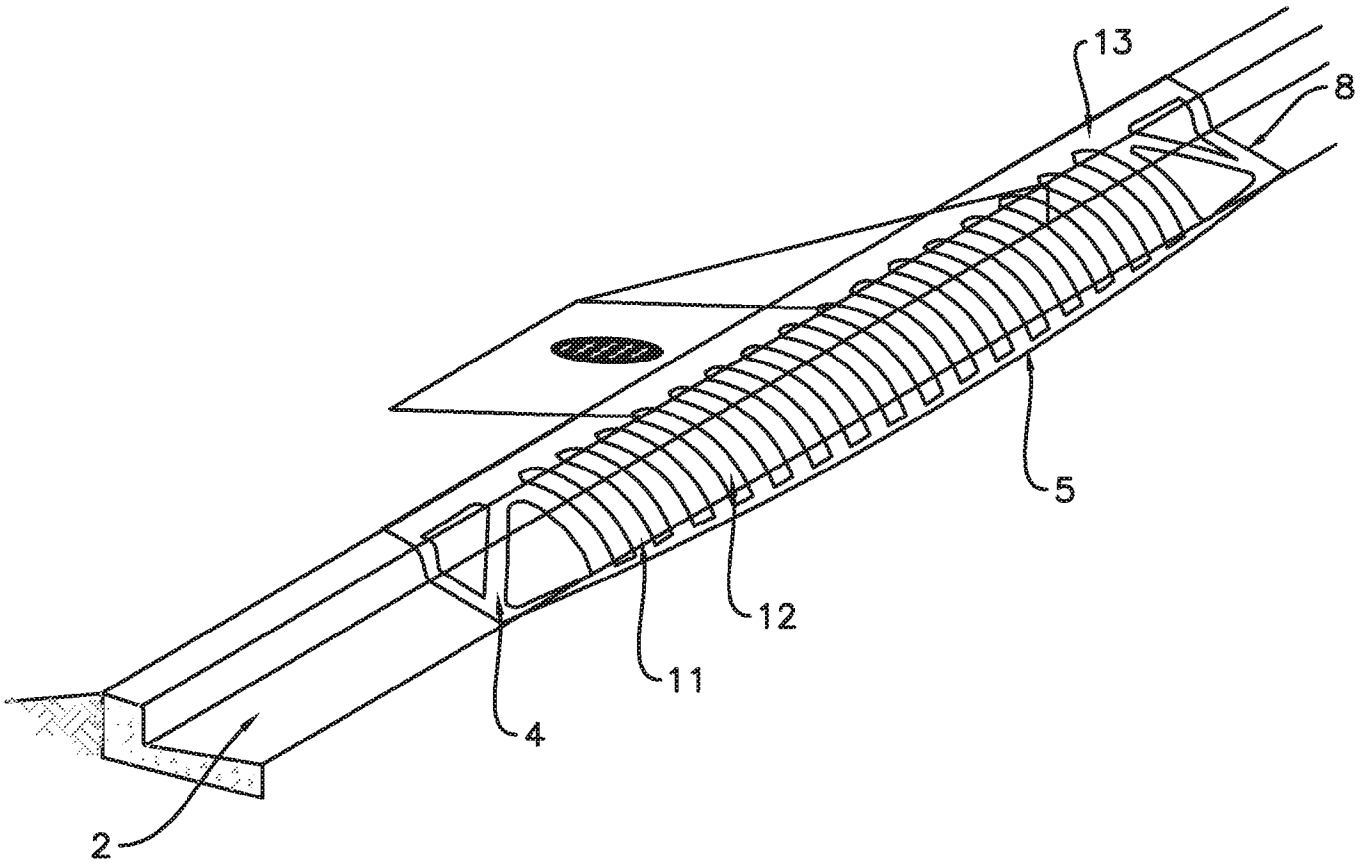
FIG. 1 is a perspective view of the Flow Shield covering a standard single wing curb inlet.

FIG. 1 illustrates a perspective view of the Flow Shield installed over a typical single wing curb inlet cover. The top 13 of the Flow Shield body lies flush with the top of the curb 2. The bottom toe 5 of the Flow Shield grid lies flush along the edge of the gutter or road. The Flow Shield contains a number of ribs 11 that link the top 13 to the bottom toe 5 forming a grid. The ribs 11 allow water above the curb and at street level to enter the Flow Shield and to be filtered before entering the storm sewer system. The ribs 11 are flanked by a number of spaces 12 that are approximately 75 to 100 mm in width. Positioned at the outermost ends of the bottom toe 5 is a triangular space 10. There are a total of two triangular spaces 10 per Flow Shield. Positioned at the outermost ends of the top 13 is an irregular space 14. There are total of two irregular spaces 14. Each irregular space 14 lies flush with the vertical sidewall of the curb 2 and flush with the top of the curb 2. A transverse rib 4 separates each triangular space 10 from the irregular space 14. The triangular spaces 10 in conjunction with the irregular spaces 14 form the sides 8 of the Flow Shield. The triangular spaces 10 and irregular spaces 14 allow water traveling along the curb to enter into the Flow Shield so that the water can be filtered as it enters the storm sewer system.

Figure 2:
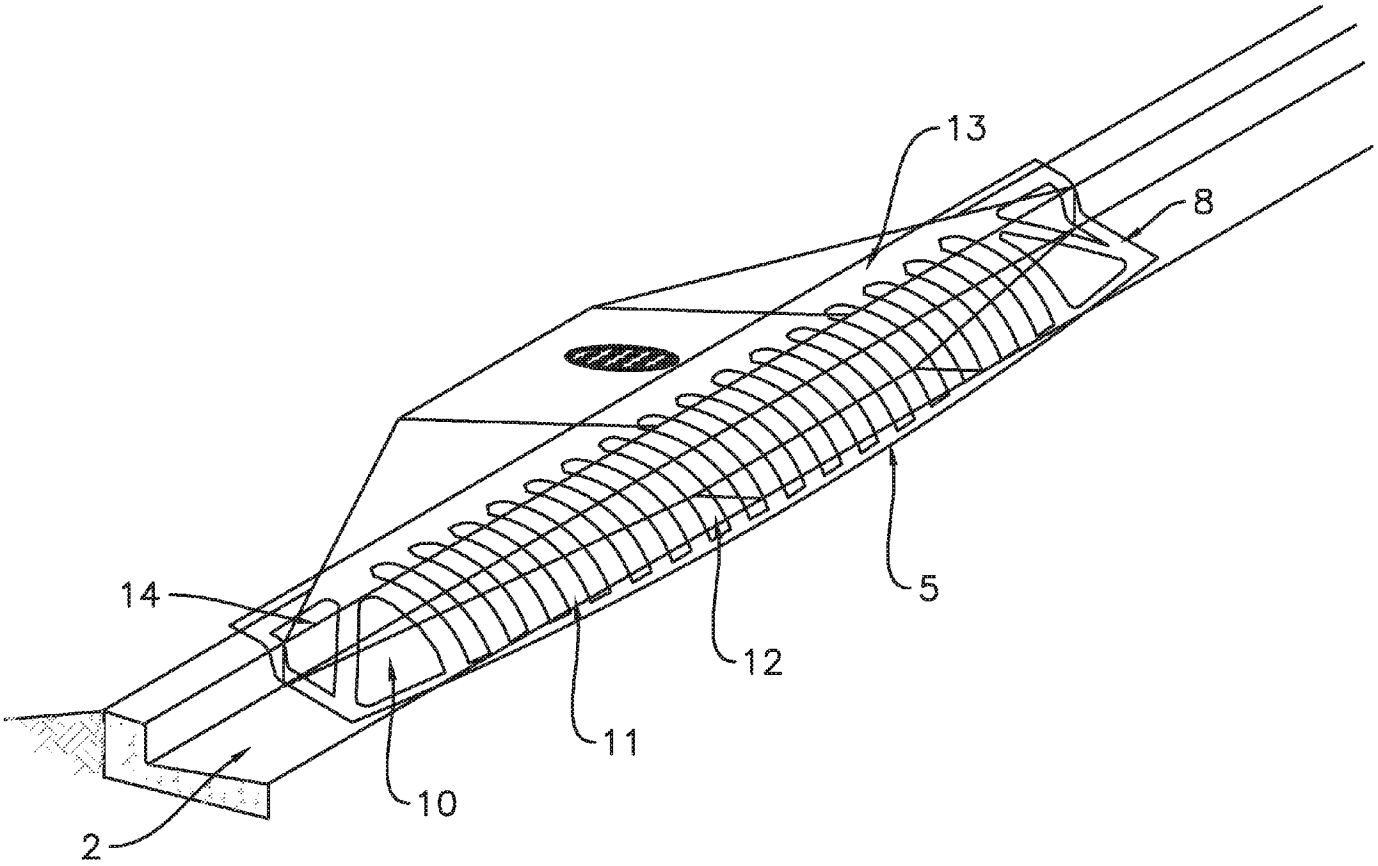
FIG. 2 is a perspective view of the Flow Shield covering a standard double wing curb inlet.
Figure 3:
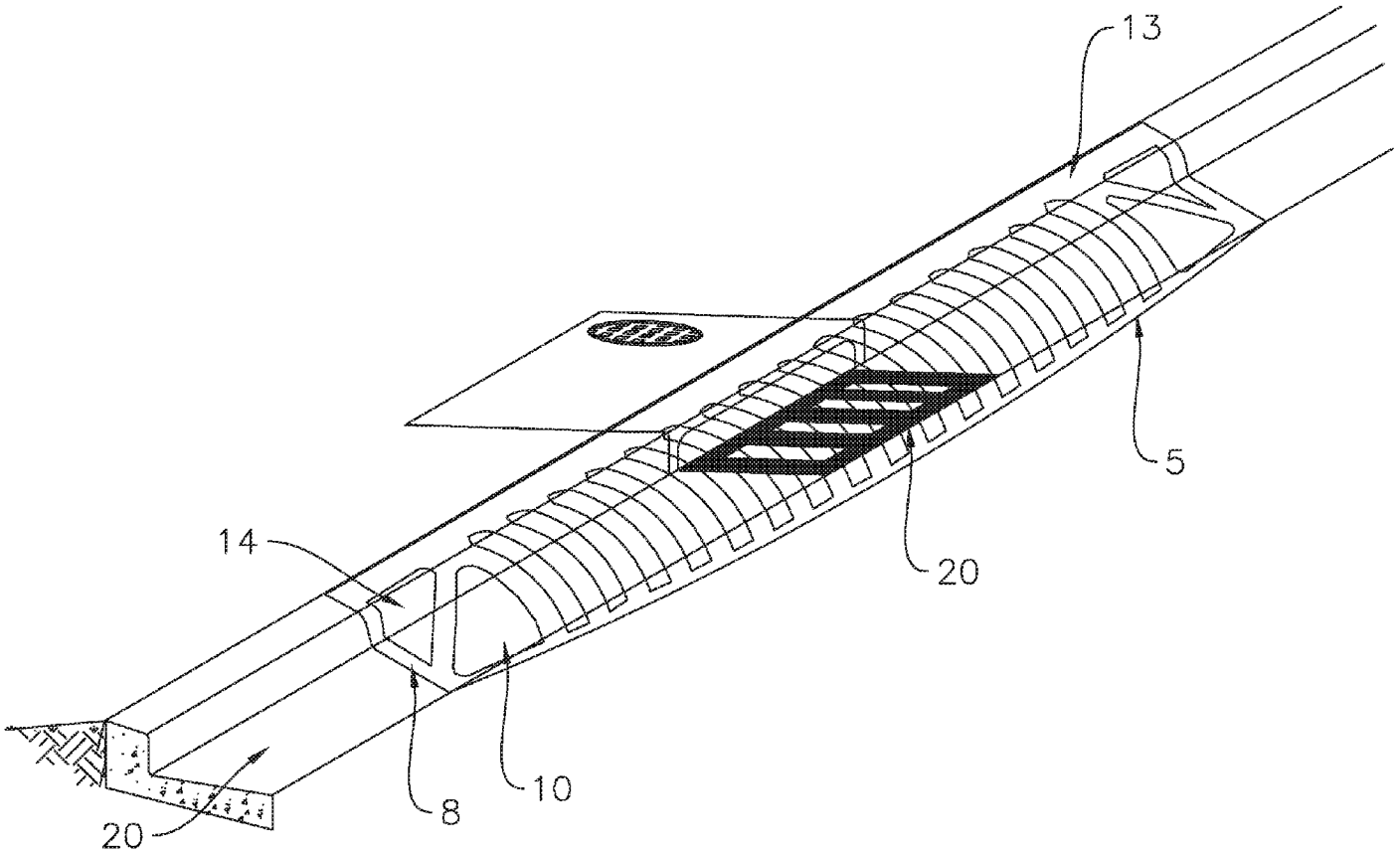
FIG. 3 is a perspective view of the Flow Shield covering a standard combination curb and gutter inlet.

FIG. 2 depicts the Flow Shield covering a typical double wing curb inlet. The length of the Flow Shield is sufficient to cover the entire length of the double wing curb inlet. In one embodiment, the Flow Shield is approximately 4.42 m long. This length is sufficient to allow the Flow Shield to completely cover the entire inlet. FIG. 3 illustrates the Flow Shield covering a typical combination curb and gutter inlet. The Flow Shield is centered above the grate 20 of the inlet.

Figure 4:
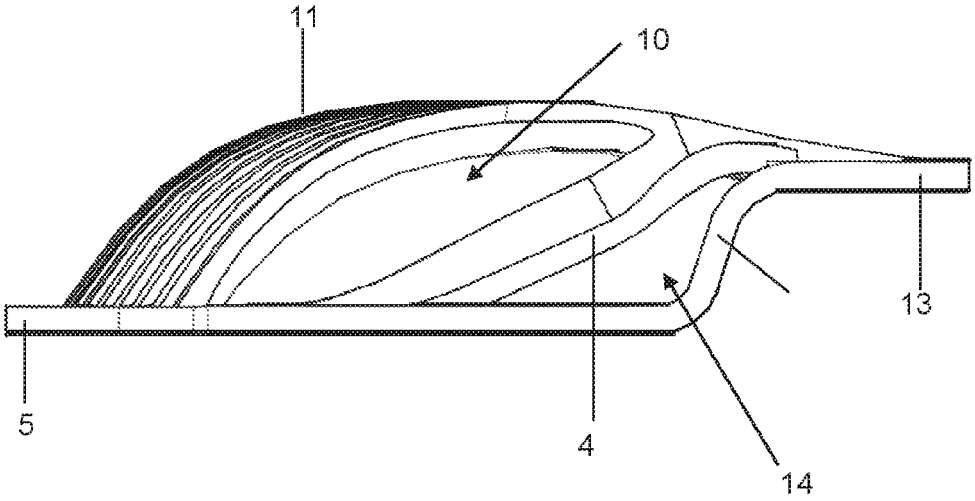
FIG. 4 illustrates a side view of the Flow Shield.

FIG. 4 illustrates a side view of the Flow Shield. The side 8 connects the top 13 to the bottom toe 5. In one embodiment, the side 8 is approximately 0.68 meters long. The side 8 lies flush against the gutter or road at the point where the side 8 contacts the bottom toe 5. Side 8 is of sufficient length to allow the Flow Shield to fully enclose a gutter grate 20. Side 8 runs horizontally until it contacts the vertical edge of the curb 2. When the side 8 meets the beginning of the vertical section of the curb 2, side 8 curves and runs vertically 0.15 m the height of the curb 2. Once the vertical portion of side 8 is the height of the curb 2, the side 8 curves until the side 8 is horizontal and flush with the curb 2. The top 13 is of sufficient width to allow gravel bags to be placed upon it to secure the Flow Shield over the sewer system inlet. The transverse rib 4 connects the side 8 to the top 13 of the Flow Shield forming the triangular space 10 and the irregular space 14.

Figure 5:
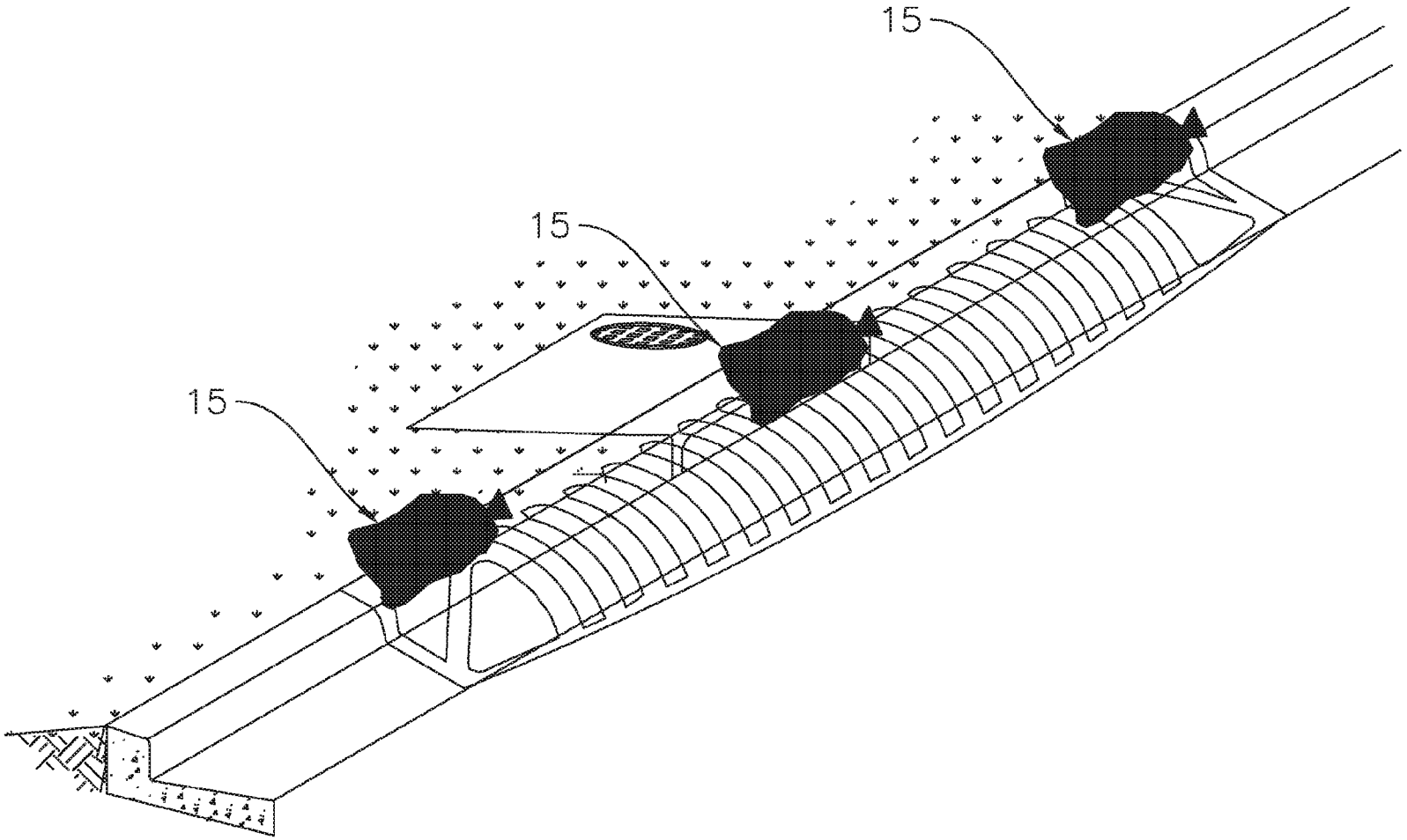
FIG. 5 is a perspective view of the Flow Shield secured to a standard curb inlet with gravel bags.
Figure 6:
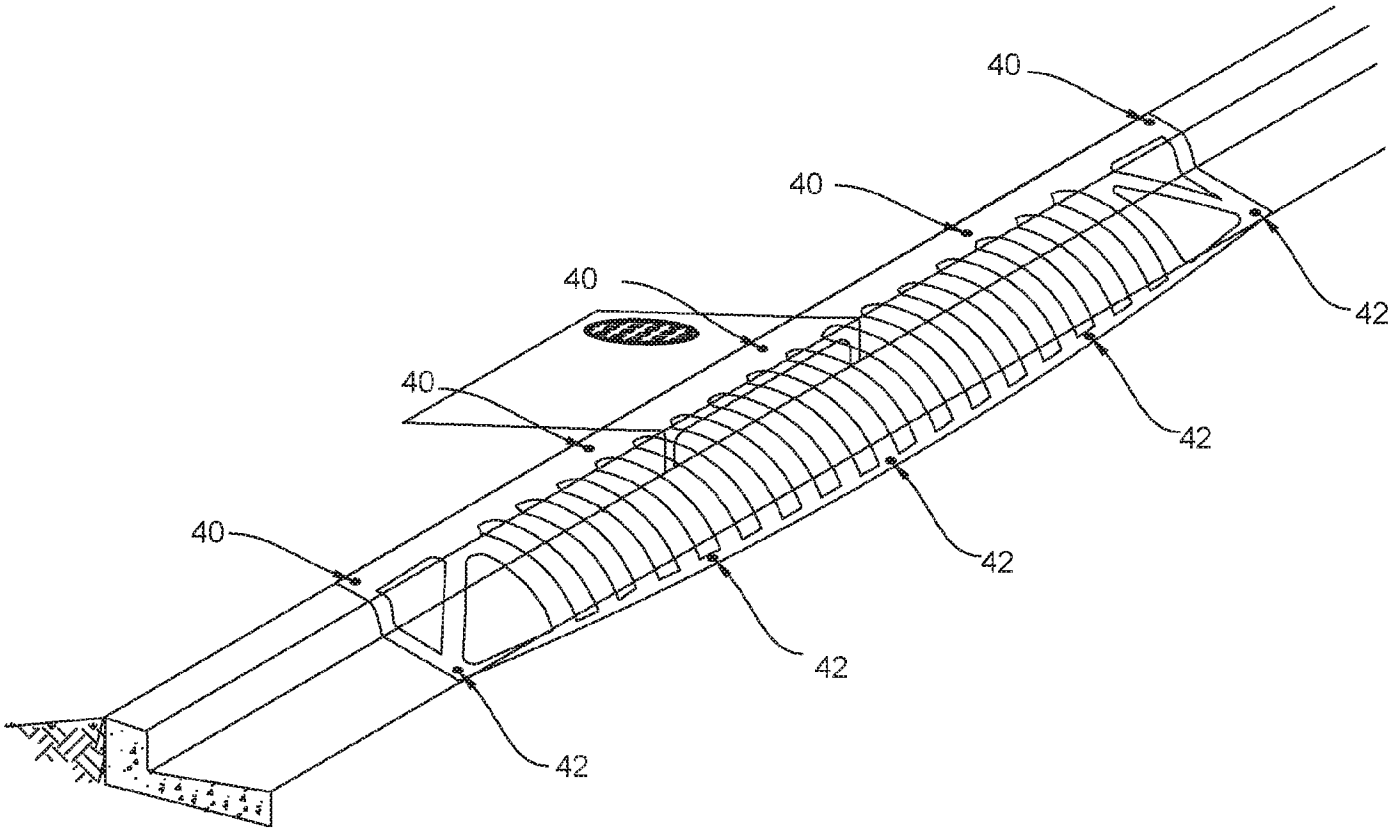
FIG. 6 is a perspective view of the Flow Shield anchored to a typical combination curb and grate inlet with concrete tapping screws.

The Flow Shield must be secured in position to work properly. This can be performed by anchoring the device with gravel or with tapping screws. FIG. 5 illustrates the Flow Shield anchored to a curb inlet by gravel bags. Once the Flow Shield has been placed in the optimum location, bags of gravel 15 can be quickly positioned onto the top 13 of the Flow Shield. The placement of two or more bags of gravel will anchor the Flow Shield so that it is secured atop the curb inlet to filter runoff. Concrete tap screws may be used to secure the Flow Shield into position. FIG. 6 illustrates the Flow Shield secured onto a curb inlet via concrete tapping screws. The top 13 contains a plurality of circular openings or eyelets 40 running the length of the top 13. Once the Flow Shield has been positioned atop the sewer system inlet, concrete tapping screws can be placed through eyelets 40, which are located on the top 13. Next, the concrete tapping screws can be tapped until they anchor the top 13 to the curb 2. The bottom toe 5 has a plurality of circular openings or eyelets 42 running the length of the toe 5. Concrete tapping screws can be tapped through the eyelets 42 and into the road to secure the Flow Shield.

Figure 7:
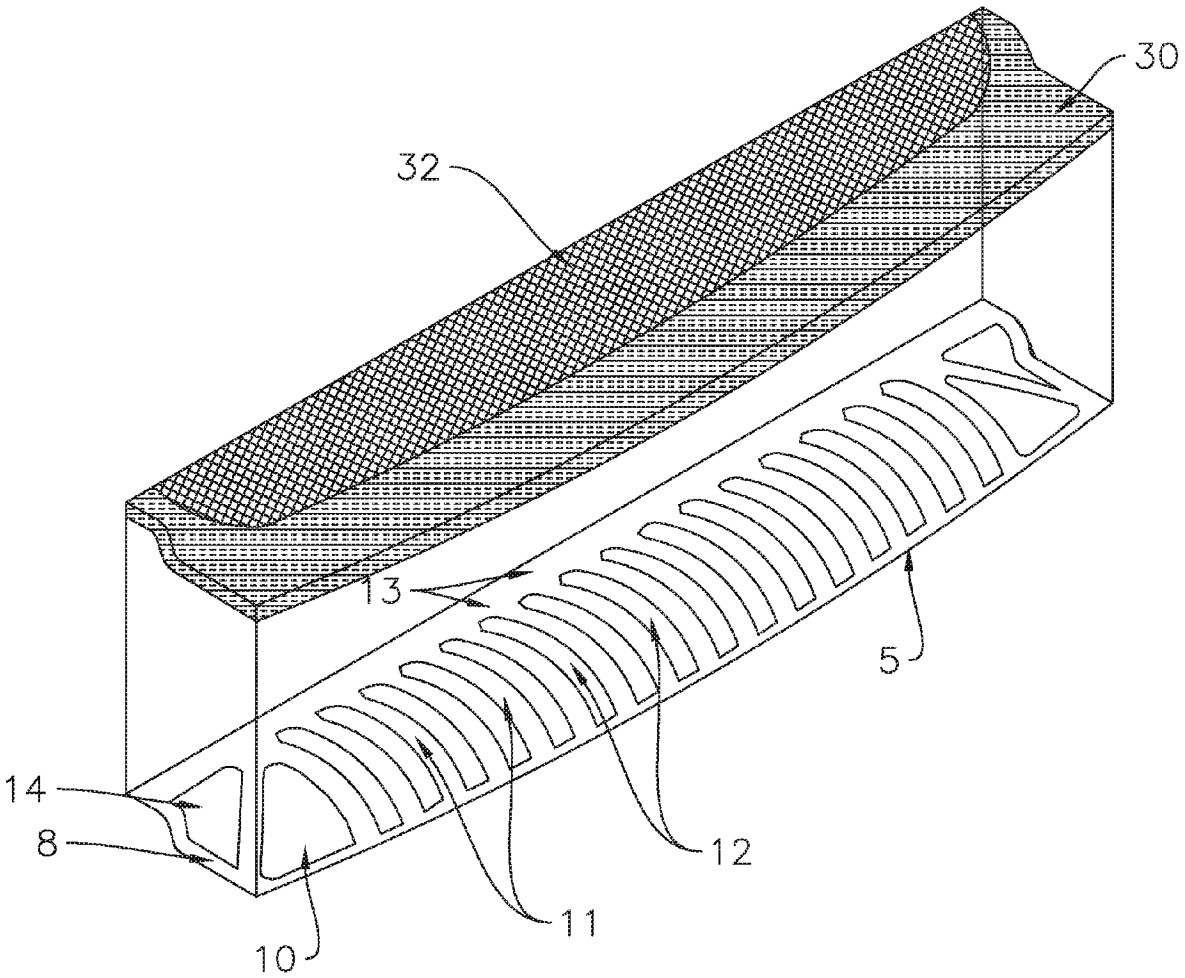
FIG. 7 is a perspective view of the Flow Shield with the filter shown above the cover.

FIG. 7 illustrates the filter of the Flow Shield. The filter utilizes a combination of non-woven filter fabric or similar high permeable mesh to create a two stage filtration system. The two-step filtration mechanism is achieved by combing a high filtration rate mesh 30 with a high flow rate mesh 32. The high filtration mesh 30 runs the length of the bottom toe 5 and along the sides 8 of the Flow Shield. The high filtration mesh creates the vertical portion of the filtering system. The high flow rate mesh 32 runs the length of the top 13 of the device and creates the horizontal portion of the filtering system. The filter fabric fits over the grid completely covering it. The filter mesh overlaps the structure on all sides with an overlap of approximately 75 to 125 mm. The fabric mesh is secured with clips and/or adhesive along the edge of the grid. Tie wraps may also be utilized to secure the filter to the grid. The filter is removable and should be replaced as needed to properly filter runoff from the construction site. The filter may be constructed so that it can be washed with a water hose and soap. The curved shape of the grid provides the filter with a large surface area to maximize the filtration rate of the Flow Shield.

The first step in filtration removes silt and sedimentation as storm water passes through the high filter mesh 30 at a rate of approximately 6,170 liters per square meters. The first step utilizes filter media 30 with a high sedimentation and silt removal rate. This first step is the primary treatment for the storm water runoff. The second step is utilized in heavy rainfall events or similar events causing large quantities of water runoff. The filter media 32 utilized in the second stage has a high flow rate to remove large floating solids and debris.

The invention claimed is:

1. An environmental barrier device comprising a frame member and a filter member attached thereto, said frame member forming a rigid grid body enclosure composed of a plurality of ribs that form a plurality of apertures, wherein said frame member includes a bottom horizontal edge that runs along the horizontal surface of a road, wherein said frame member includes a top horizontal edge that runs along the horizontal surface of a curb that is elevated above said bottom horizontal edge, wherein said frame member includes two side edges that run from said bottom horizontal edge to said top horizontal edge, wherein the plurality of ribs are positioned perpendicular to the bottom horizontal edge and the top horizontal edge, and form an are between the bottom edge and the top edge, wherein said filter member reversibly attaches to said frame member, and said environmental barrier device can filter sediment and debris from entering a storm drain.

2. The environmental barrier device of claim 1 wherein said frame member includes a top horizontal edge and a bottom horizontal edge of sufficient length to enclose a single wing curb inlet.

3. The environmental barrier device of claim 1 wherein said frame member includes a top horizontal edge and a bottom horizontal edge of sufficient length to enclose a double wing curb inlet.

4. The environmental barrier device of claim 1 wherein said frame member includes a top horizontal edge and a bottom horizontal edge of sufficient length to enclose a combination curb and gutter inlet.

5. The environmental barrier device of claim 1 anchored over a storm drain with concrete tapping screws.

6. The environmental barrier device of claim 1 anchored reversibly attached to a storm drain with two or more weights.

7. The environmental barrier device of claim 1 wherein said plurality of ribs create one or more apertures of 75 to 100 mm in width.

8. The environmental device of claim 1 composed of polyethylene, polyvinyl chloride, stainless steel, or iron.

9. The environmental barrier device of claim 1 wherein said filter member comprises high filtration mesh that runs the length of said bottom horizontal edge and said side edges and high flow rate mesh runs the length of said top horizontal edge.

10. An environmental barrier device comprising a frame member and a filter member attached thereto, said frame member forming a rigid grid body enclosure composed of a plurality of ribs that form a plurality of apertures, wherein said frame member includes a bottom horizontal edge that runs along the horizontal surface of a road, wherein said frame member includes a top horizontal edge that runs along the horizontal surface of a curb that is elevated above said bottom horizontal edge, wherein said frame member includes two side edges that run from said bottom horizontal edge to said top horizontal edge, wherein said plurality of ribs create a triangular aperture and an irregular aperture along each said side edge, wherein said filter member reversibly attaches to said frame member, and said environmental barrier device can filter sediment and debris from entering a storm drain.

11. An apparatus to filter sediment and debris entering a wing curb inlet comprising, a frame member and a filter member attached thereto, said frame member forming a rigid grid body enclosure composed of a plurality of ribs that form a plurality of apertures, wherein said frame member includes a bottom horizontal edge that runs along the horizontal surface of a road, wherein said frame member includes a top horizontal edge that runs along the horizontal surface of a curb that is elevated above said bottom horizontal edge, wherein said frame member includes two side edges that run from said bottom horizontal edge to said top horizontal edge, wherein the plurality of ribs are positioned perpendicular to the bottom horizontal edge and the top horizontal edge and form an arc between the bottom edge and the top edge, wherein said filter member reversibly attaches to said frame member, and said environmental barrier device can filter sediment and debris from entering a storm drain.

* * * * *